US006031227A

United States Patent [19]

Becker et al.

[11] Patent Number: 6,031,227

[45] Date of Patent: Feb. 29, 2000

[54] TIME-OF-FLIGHT MASS SPECTROMETER WITH POSITION-SENSITIVE DETECTION

[75] Inventors: Uwe Becker; Franz Heiser, both of Berlin, Germany

[73] Assignee: Max-Planck-Gesellschaft Zur Foerderung Der Wissenschaften E.V., Munich, Germany

[21] Appl. No.: 09/068,075

[22] PCT Filed: Oct. 31, 1996

[86] PCT No.: PCT/EP96/04732

§ 371 Date: Aug. 17, 1998

§ 102(e) Date: Aug. 17, 1998

[87] PCT Pub. No.: WO97/17718

PCT Pub. Date: May 15, 1997

[30] Foreign Application Priority Data

Nov. 3, 1995 [DE] Germany ..... 195 41 089

[51] Int. Cl.[7] ..... H01J 37/26

[52] U.S. Cl. ..... 250/287

[58] Field of Search ..... 250/287, 286, 250/397

[56] References Cited

U.S. PATENT DOCUMENTS

| | | | |
|---|---|---|---|
| 5,061,850 | 10/1991 | Kelly et al. | 250/306 |
| 5,619,034 | 4/1997 | Reed et al. | 250/287 |
| 5,777,325 | 7/1998 | Weinberger et al. | 250/287 |
| 5,777,326 | 7/1998 | Rockwood et al. | 250/287 |

FOREIGN PATENT DOCUMENTS 0 488 067 A2 6/1992 European Pat. Off. .

OTHER PUBLICATIONS

Werner et al., "3D Imaging of the Collision–Induced Coulomb Fragmentation of Water Molecules", *Physical Review Letters*, vol. 74, No. 11 (Mar. 13, 1995), pp. 1962–1965.

Kinguwa et al., "Position–sensitive time–of–flight mass spectrometer using a fast optical imaging technique", *Rev. Sci. Instrum. 63* (Jul. 1992), pp. 3599–3607.

Moskovets et al., "Cat's –eye reflectron", *Applied Physics B*, (1994), pp. 547–552.

Wang et al., "Determination of laser beam waist using photoionization time–of–flight mass spectrometer", *Rev. Sci. Instrum. 65*, (Sep. 1994), pp. 2776–2780.

Eland, J HD, "Simple two–dimensional position–sensitive detector with short dead–time for coincidence experiments", *Journal of Physics E. Scientific Instruments*, No. 12 (Dec. 1994), pp. 1501–1504.

Pollard et al., "Time–resolved mass and energy analysis by position–sensitive time–of–flight detection", *Rev. Sci. Instrum. 61* (Oct. 1990), pp. 3134–3136.

Eland et al., "Simple radial position–sensitive detector with short deadtime for time–of–flight and coincidence experiments", *Meas. Sci. Technol. 1* (1990), pp. 36–40.

*Primary Examiner*—Kiet T. Nguyen
*Attorney, Agent, or Firm*—Duane, Morris & Heckscher LLP

[57] ABSTRACT

Time-of-flight mass spectrometer with a position-sensitive detector (20) for determining energy and pulse of photodissociated ions, the detector (20–24) comprising one or a plurality of electron multipliers (21, 22) and an anode array (23) arranged behind the electron multipliers for determining the position of impringement of the ions, and the time-of-flight mass spectrometer including devices (30–33) for determining the time of flight of the ions.

9 Claims, 5 Drawing Sheets

TIME-OF-FLIGHT MASS SPECTROMETER WITH POSITION-SENSITIVE DETECTION

The present invention relates to a time-of-flight mass spectrometer with a position-sensitive detector which comprises at least one electron multiplier and an anode array for detecting the electrons released in the electron multipliers.

For understanding the processes that take place during light-induced ionization and subsequent dissociation of molecular systems, the reaction products must be identified and energy and pulse of said products must be determined. Photoionized molecules normally dissociate into electrons and ions which must be detected simultaneously. Energy and pulse of such photodissociated fragments can, for instance, be determined by a time-of-flight mass spectrometer, including a position-sensitive detector, with the aid of which the time of flight and the position of impingement of the fragments can be determined. The position-sensitive detectors which are known in the prior art have various disadvantages. Relatively frequent use is made of detectors based on resistive anodes which, however, have very long dead times as a rule, whereby the time resolution of the system is limited. Other detectors consist of a matrix of anodes that are crossed and interconnected in rows and columns, as are, for instance, illustrated in the publication by J. H. D. Eland in Meas. Sci. Technol. 5, 1501–1504 (1994). In these detectors, too, the dead times are long because of the use of delay lines for an indirect position determination from signal travel time measurements and of digital circuits for the time measurement.

It is therefore the object of the present invention to provide a time-of-flight mass spectrometer comprising a position-sensitive detector of improved time and position resolution.

This object is achieved by the subject of patent claim 1. Advantageous embodiments follow from the subclaims.

The detector of the invention consists of at least one electron multiplier and an anode matrix which is arranged behind each electron multiplier and in which anodes are respectively interconnected in lines or columns and each line and each column are connected to a respective output terminal. The electrons which are released in the electron multiplier are detected in position-sensitive fashion by the anodes. The time is measured in a device that is independent of the anode matrix. This device may, for instance, be an analog circuit with the aid of which a time resolution of about 100 ps can be achieved. This is an improvement in time resolution by more than a factor 10 in comparison with the prior art.

The invention will now be explained in more detail with reference to the figures, of which:

FIG. 1 schematically illustrates a first embodiment of the invention;

FIG. 2 is a schematic diagram for explaining the processes that take place during detection;

FIG. 3 schematically illustrates a further embodiment of the invention;

Figure 1:
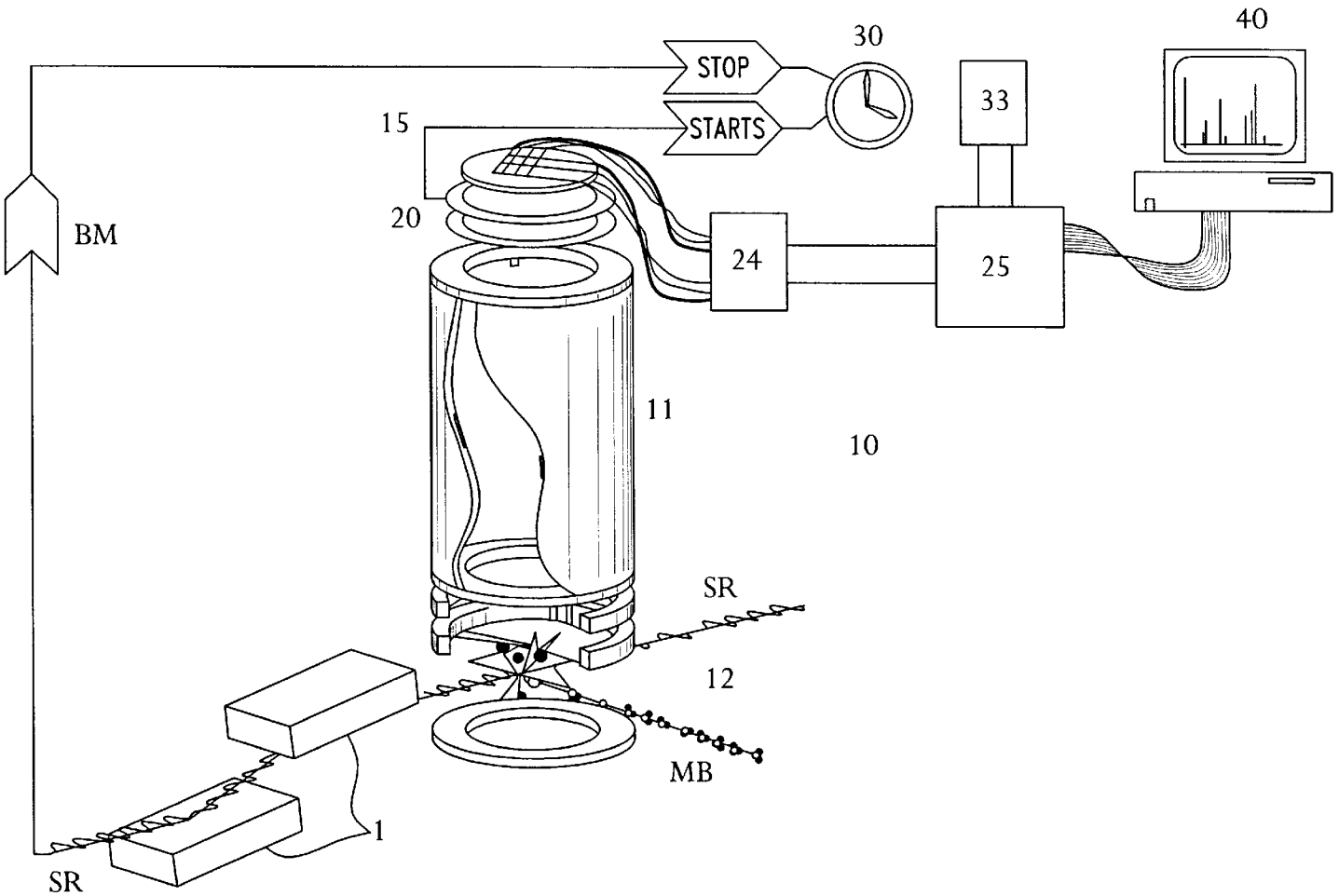

FIG. 1 shows the basic function of the detector of the invention in a schematic and exemplary manner. In an interaction zone 12 of a time-of-flight mass spectrometer 10 an approximately monochromatic synchrotron radiation SR impinges on the molecules of a molecular beam MB. The synchrotron radiation may, for instance, be emitted by a synchrotron storage ring and guided through a wavelength-selective element, such as a grating or crystal monochromator 1. As a result of the interaction of the synchrotron radiation with the molecules, the latter are ionized and possibly dissociate into individual ions and electrons, of which the ions are to be detected in time- and position-resolved fashion by a detector 20 which is arranged at the end of a drift tube 11.

Figure 2:
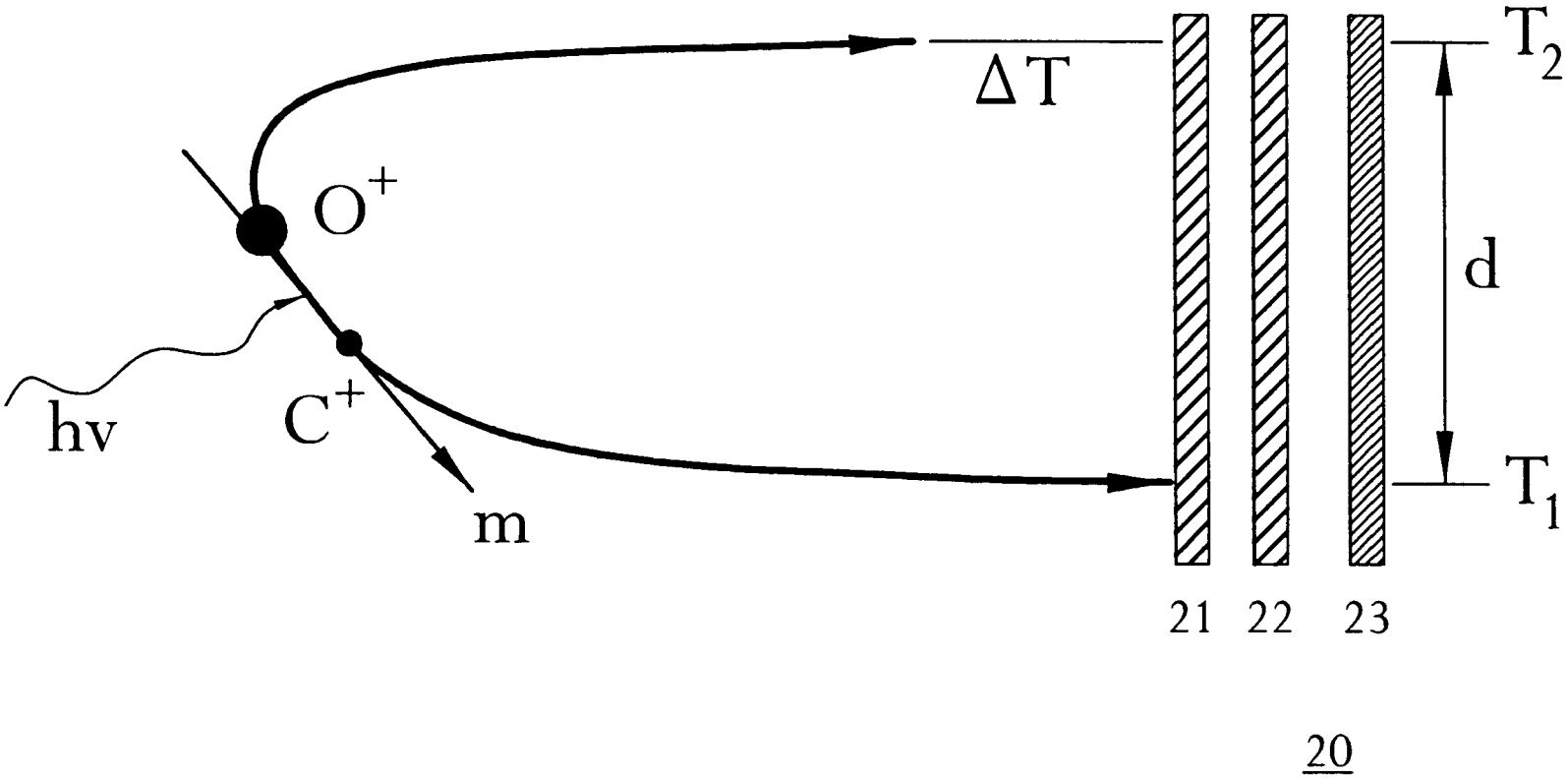

FIG. 2 schematically illustrates the measuring principle with reference to the dissociation of a CO molecule. On the basis of the positions and times measured for the ions that impinge on the detector 20, energy and pulse of said ions shortly after fragmentation can be determined. The detector 20 consists of two sucessively arranged multichannel plates 21, 22 and of the anode matrix 23 which is arranged at such a distance from the second multichannel plate 22 that an electron cloud which has been released in the multichannel plates impinges on at least one anode. Instead of multichannel plates, it is possible to use other electron multipliers. In the present case the anode matrix consists of 900 planar anodes which are arranged in regular fashion in 30 lines and 30 columns. Hence, on the whole, the anode matrix consists of 1800 partial anodes, of which two partial anodes respectively form a planar anode. An example of the geometrical shape of the partial anodes will be explained further below with reference to FIG. 5. The anodes are arranged and dimensioned in such a manner that multichannel plates or so-called microsphere plates with a diameter of 40 mm can be used. The anodes are at a potential which is by 2800 V higher than the front side of the first multichannel plate 21 which is at −4000 V relative to ground. This voltage focuses the electron cloud such that it impinges on at least one anode (two partial anodes). The partial anodes are respectively interconnected along each line (X) and each column (Y), and each line and each column are connected to an output terminal, so that a total of 60 wires have to be guided out of the vacuum chamber to the outside. Hence, upon each event, an anode is hit and a respective signal is produced at an X-line and a Y-line. These signals are first supplied to a position decoder 24 for detecting the position. The position decoder 24 will respond when two neighboring partial anodes have simultaneously been hit by the electron wave.

A feature of the present invention is that time measurement is performed by devices which are independent of the anode matrix and the remaining position-determining means. FIG. 1 illustrates the principle of time measurement.

A thin metal plate which is mounted on the back side of the second multichannel plate 22 (see FIG. 2), or a metal coating applied to a substrate, serves to measure the time. The electrons which have been released in the multichannel plates pass in substantially unhindered fashion through the metal plate while moving towards the anode. In this metal plate, however, a pulse is generated (hereinafter designated as ion signal IS) which is used for time measurement. The time of said pulse is considered to be representative of the time when the ions impinge on the first multichannel plate. The start time of the ion analysis is taken as a reference point. In the present example, this is the time of ionization by the synchrotron radiation pulse which enters into the interaction zone. The so-called bunch marker (BM) signal, a pulse derived from the high-frequency control of the synchrotron, is considered to be representative of said time. These two signals are supplied to a plurality of time-to-amplitude converters (TAC) whose output signal is converted into a digital signal in analog-digital converters (ADC), the number of which corresponds to that of the TACS, and is supplied to the data acquisition interface 25.

The next BM signal represents the stop time of the ion analysis and is therefore supplied as a stop signal to the TACs, while the ion signals are supplied to the TACs as start signals. The TACs have, for instance, a dead time of 2.5 $\mu$s after the start signal, while the synchrotron period is 200–1000 ns.

Instead of the TAC-ADC combination, means can also be used that directly convert the time magnitudes into digital signals (so-called time-to-digital converters, TDC).

Figure 3:
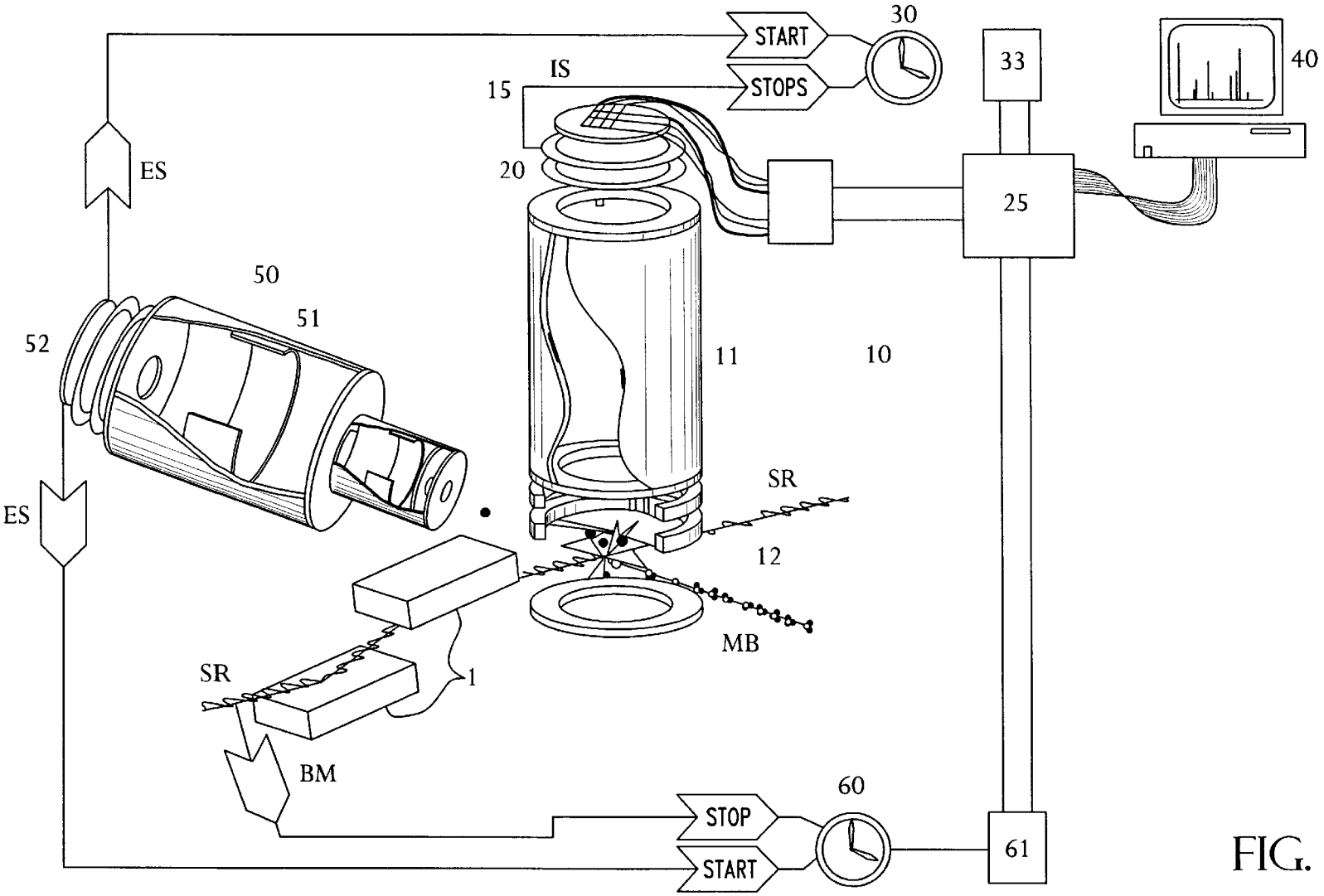

FIG. 3 illustrates a further embodiment of the present invention, in which the electrons are additionally detected by an electron spectrometer 50. Identical reference numerals have here been used for components corresponding to those of FIG. 1. The electron spectrometer 50 contains a drift tube 51 and an electron detector 52 which, as illustrated, may have a structure similar to that of the ion detector, i.e. it can contain two multichannel or microsphere plates and an anode, with the anode of the electron detector being possibly also configured as a large-area anode. In this embodiment, the signal of the electron detector (hereinafter designated as electron signal ES) is used as a reference signal for the time measurement of the ion events, i.e., it is supplied as the start signal to the TACs. The electron signal and the BM signal are supplied to a TAC 4 (see FIG. 4) for measuring the time of flight of the electrons. The electron signal is supplied as the start signal and the BM signal as the stop signal to the TAC 4. Hence, the interval between the occurrence of the electron signal and the BM signal that follows the BM signal causing the electron signal is always measured. The analog signal of the TAC 4 is supplied to an ADC 4, and the output signal thereof is supplied to the data acquisition interface 25.

Figure 4:
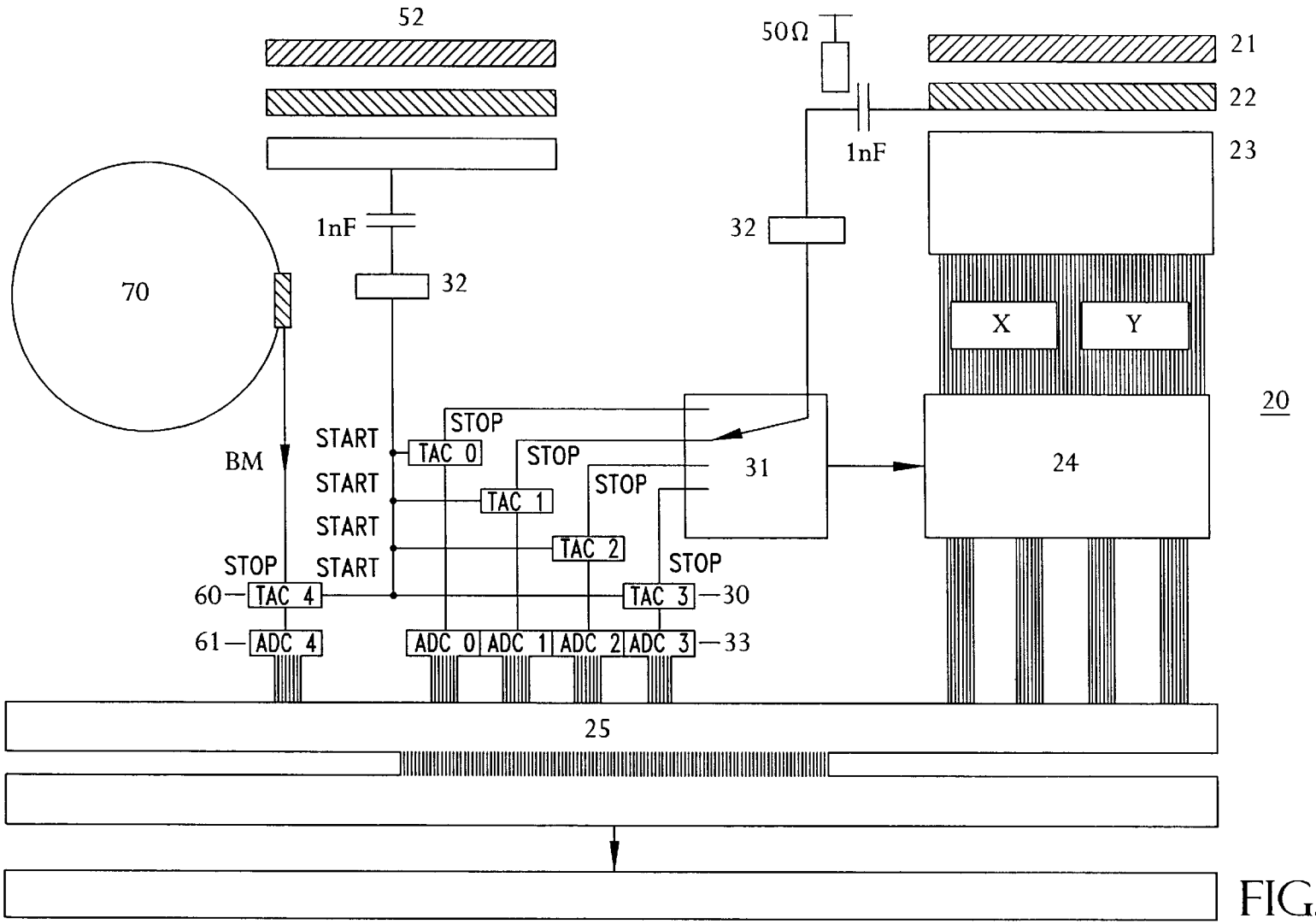
FIG. 4 is a block diagram of the embodiment of FIG. 3.

FIG. 4 shows details of the time measuring device in greater detail. The circuit as shown refers to the embodiment of FIG. 3. The travel times of the ions detected by the ion detector are measured in TACs 0–3. They receive the start signal from the anode of the electron detector 52. The electron travel time is determined in TAC 4 in that, as mentioned, the electron signal is supplied as the start signal and the BM signal of the successive cycle, which has been received from the synchrotron 70, as the stop signal. The ion signals which are produced at the metal plate on the back side of the second multichannel plate are supplied along a line to a high-speed switch (MUX) 31 whose task consists in subsequently distributing the signals over the TACs 0–3. Hence, in the illustrated example, an electron and four ions can be detected in a measurement cycle. Of course, the number of TACs as selected is an arbitrary one and can very easily be increased. Each TAC has assigned thereto an ADC which has a time dispersion of 0.1 ns per channel that at a suitably fast rise time of the ion signals can also be chosen such that it is smaller and can be reduced down to 30 ps. Before being supplied to the MUX and the TACs, the ion and electron signals are amplified by an amplifier (not shown) by the factor 50 to 100 and are then converted in a discriminator 32 (CFD, constant fraction discriminator) into standard pulses. This has the effect that time measurement in the TAC is started at comparable times for original pulses with a similar shape (rise time), but different amplitude. The exact operation of this commercially available component is described in more detail in the literature, for instance in the dissertation by B. Langer, TU Berlin (Technical University of Berlin), 1992. The MUX 31 is connected to the position decoder 24 and sends a gate trigger signal to said decoder to permit an assignment of the measured time signals to the measured position signals.

Since the signals from the anode rows and columns have very short rise times and a very short pulse duration (rise time+duration$\leqq$5 ns, amplitude about 5 mV), they can no longer be read out directly with a computer. Therefore, a pattern recognition system is interposed as a rapid unit which upon occurrence of an electron cloud loads the relevant information about the position into a very rapid memory. Already after 5 ns, a new event position can be written into this memory again, so that the dead time for readout will only depend on the speed of the rapid memory in this pattern recognition system. The pattern recognition system forms part of the data acquisition interface 25 and has the additional task to code the position signals in binary form.

The electron pulses have a width of about 2 ns and an amplitude of 20 mV. The dead time of the system according to FIGS. 3 and 4 after detection of an electron is defined by the width of the ion signals and the dead time of the MUX 31 and is less than 7 ns. In principle, the widths of the signals and the dead time of the MUX can each be reduced to less than 1 ns. Therefore, the system makes no fundamental distinction as to the smallest possible interval between two ion events, as the width of the signals is of essential importance. In case the amplified signals from the anode lines are digitized by an ultrafast ADC, it is also possible to interpolate between different lines to obtain a position resolution in the range of 0.1 mm instead of 1.5 mm, as in the illustrated examples.

Figure 5:
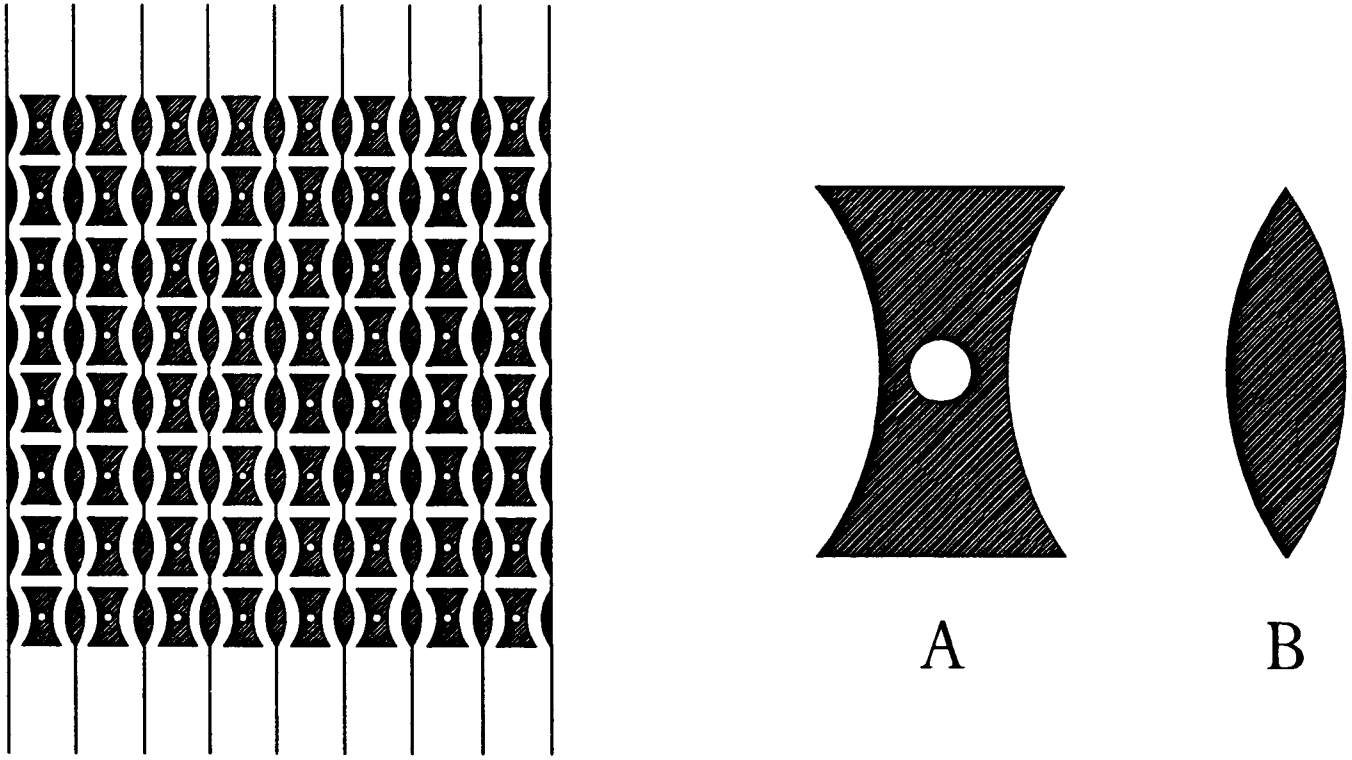
FIG. 5 is an example of an anode pattern of an anode matrix.

FIG. 5 shows an example of a position-sensitive anode matrix (cutout) used according to the invention. The anode matrix is formed as a planar pattern, with each anode comprising two partial anodes (A, B shown in the right part of the figure on an enlarged scale). The partial anodes A and B correspond to the subpixels in x-direction and y-direction, respectively. The partial anodes A and B are mounted on an anode plate. The partial anodes A are each connected in rows by electrical connections (not shown) on the back side of the anode plate. The partial anodes B are each connected in columns by electrical connections on the front side of the anode plate. Each row and column of partial anodes have assigned thereto a respective output terminal which is connected to a fast preamplifier. A special advantage of the invention is that the assignment of output terminals to each line and each column permits a genuine determination of the position without any signal travel time measurements in delay lines. As a result, the speed of the position-sensitive detector of the invention is considerably increased. A further advantage is that a possible increase in the anode matrix area for adaptation to a specific measurement structure does not, for instance, lead to a slowing down of the measuring operations. Furthermore, when the matrix area is increased by a certain factor, the number of conduction lines will just be increased by the square root of said factor.

The position-sensitive detector of the invention can be used in many ways in all fields of application where the occurrence of particles, in particular, is to be measured with a high resolution of time and position. The invention has been described above with reference to a mass spectrometer. The detector of the invention, however, can also be used in an electron spectrometer or in an analyzer for neutral particles.

We claim:

1. Time-of-flight mass spectrometer with a position-sensitive detector which comprises at least one electron multiplier and a regular anode array for detecting electrons released in the electron multipliers, said anode array comprising line anodes and column anodes, said line anodes which are arranged in each line being electrically interconnected and said column anodes which are arranged in each column being electrically interconnected, characterized in that said anode array has a number of first output terminals corresponding to the number of line anodes and a number of second output terminals corresponding to the number of column anodes, said first and second output terminals being connected to a position decode, and that said time-of-flight mass spectrometer includes means for determining the time of flight of charged particles.

2. The time-of-flight mass spectrometer according to claim 1, characterized in that said means is controllable by first and second start signals which are representative of the start time of a measurement, and by a stop signal (IS) caused by the impingement of charged particles on said electron multiplier.

3. The time-of-flight mass spectrometer according to claim 2, characterized in that said means includes at least one time-to-digital converter or at least one time-to-amplitude converter which contains two input terminals for the supply of said start signals and said stop signal, respectively, and an output terminal connected to an analog-digital converter.

4. The time-of-flight mass spectrometer according to claim 3, characterized in that said means comprises at least two time-to-amplitude converters and a switch which comprises an input terminal for the supply of said stop signal, and a plurality of output terminals each connected to an input terminal of said time-to-amplitude converters, and said switch is a multiplexer switch being adapted to supply each of subsequent stop signals of a measurement cycle to one of said output terminals.

5. The time-of-flight mass spectrometer according to claim 1, characterized in that said electron multipliers and the anodes of the anode array are subjected to electric potentials such that an electron cloud released in said electron multipliers impinges on at least one pair of neighboring line and row anodes.

6. The time-of-flight mass spectrometer according to any one of claims 2 to 5, characterized in that the start time is given by the time of ionization of molecules to be investigated, by a radiation pulse of the electromagnetic synchrotron radiation, and said first start signal is a signal derived from the high-frequency control of the synchrotron.

7. The time-of-flight spectrometer according to claim 1, characterized by an electron spectrometer comprising an electron detector for providing said second start signal.

8. The time-of-flight mass spectrometer according to claim 7, characterized by a time-to-analog converter including two input terminals for the independent supply of said first and second start signals and an output terminal connected to an analog-digital converter for coincidently recording both the first and second start signals.

9. The time-of-flight mass spectrometer according to claim 1, characterized in that said electron multipliers are microsphere plates or multichannel plates.

* * * * *